US006820308B1

(12) United States Patent
Crittenden

(10) Patent No.: US 6,820,308 B1
(45) Date of Patent: Nov. 23, 2004

(54) HINGE APPARATUS AND METHOD OF MAKING A HINGE RECESS

(76) Inventor: Jerry G. Crittenden, 16220 N. 1st Ave., Phoenix, AZ (US) 85023

( * ) Notice: Subject to any disclaimer, the term of this patent is extended or adjusted under 35 U.S.C. 154(b) by 44 days.

(21) Appl. No.: 10/308,263

(22) Filed: Nov. 27, 2002

(51) Int. Cl.[7] ..... E05D 5/02
(52) U.S. Cl. ..... 16/387
(58) Field of Search ..... 16/387, 221, 222, 16/247, 384, 385, 388, 248; D8/323, 327, 328, 329

(56) References Cited

U.S. PATENT DOCUMENTS 3,063,087 A * 11/1962 Thomas ..... 16/387
4,543,687 A * 10/1985 Law ..... 16/388
4,686,743 A * 8/1987 Suska ..... 16/389
5,040,268 A * 8/1991 Knurr ..... 16/261
5,058,236 A * 10/1991 Henson ..... 16/222
5,606,775 A * 3/1997 Dame ..... 16/387

* cited by examiner

*Primary Examiner*—Chuck Y. Mah
(74) *Attorney, Agent, or Firm*—H. Gordon Shields

(57) ABSTRACT

Hinge apparatus includes convexly rounded top and bottom rear surfaces on the hinge leaves and concavely rounded hinge receiving recesses on doors and door frames which receive the hinge leaves. The recesses are routed from generally parallel to the plane of the door edge from which the recesses extend downwardly into the door edge and door frame or jamb. A method of making the recesses includes providing router elements which make the recesses by relative motion between the router elements and the door or door frame which receive the hinges.

3 Claims, 3 Drawing Sheets

HINGE APPARATUS AND METHOD OF MAKING A HINGE RECESS

BACKGROUND OF THE INVENTION

1. Field of the Invention

This invention relates to hinges and to a method of installing hinges, and, more particularly, to hinges having rounded top and bottom rear surfaces and to hinge recesses for receiving the hinges, and to a method of installing such hinges in recesses with rounded mating top and bottom portions.

2. Description of the Prior Art

Hinges of the prior art for doors, both cabinetry and room, typically are recessed in both the door and the frame. The recesses are typically made by routing from generally perpendicularly to the plane of the door and the frame. Such routing takes several passes of the router and results in rounded corners at the top and bottom rear of a recess. As a result of the rounded corners, either the hinges must also have rounded outer corners or else the recess must have its corners squared. The squaring of the corners is typically accomplished by chiseling out the rounded corner. This chiseling step requires both extra time and manpower either at the site of the door installation or else at the plant/factory when a door is preinstalled in a door frame.

The apparatus and method of the present invention eliminates the extra step in installation of hinges by routing the hinge recess from generally parallel to the plane of the surface into which the recess is made and by providing hinges with rounded top and bottom rear surfaces for those recesses. Thus, time is saved in both the making of the recesses for the hinges and in the installation process, and the aesthetics of square corners for the hinge and its recesses are preserved.

When the top and bottom ends of the hinge recesses are square, paint builds up and prevents the hinges from being installed flush. This results in the doors and door frames not being finish painted prior to hinge installation. However, when the top and bottom ends are concavely rounded, as with the present invention, paint buildup does not occur, and the doors and door frames may be finish painted prior to hinge installation. The ability to finish paint prior to hinge installation is another advantage of the present apparatus and method.

SUMMARY OF THE INVENTION

The invention described and claimed includes a hinge with rounded top and bottom rear portions and hinge receiving recesses for receiving such hinges. The hinges are secured in recesses which are made by routing from generally parallel to the plane of the surface into which the recess is formed, and to the method of making such recess and installing such hinge in the recess.

Among the objects of the present invention are the following:

To provide a new and useful hinge;

To provide a new and useful recess for a hinge;

To provide a new and useful method of making a hinge receiving recess;

To provide a new and useful recess for a hinge having concavely rounded top and bottom portions;

To provide a new and useful method of installing a hinge in a hinge receiving recess; and To provide a new an useful leaf hinge having convexly rounded top and bottom rear surfaces.

DESCRIPTION OF THE PREFERRED EMBODIMENT

Figure 1:
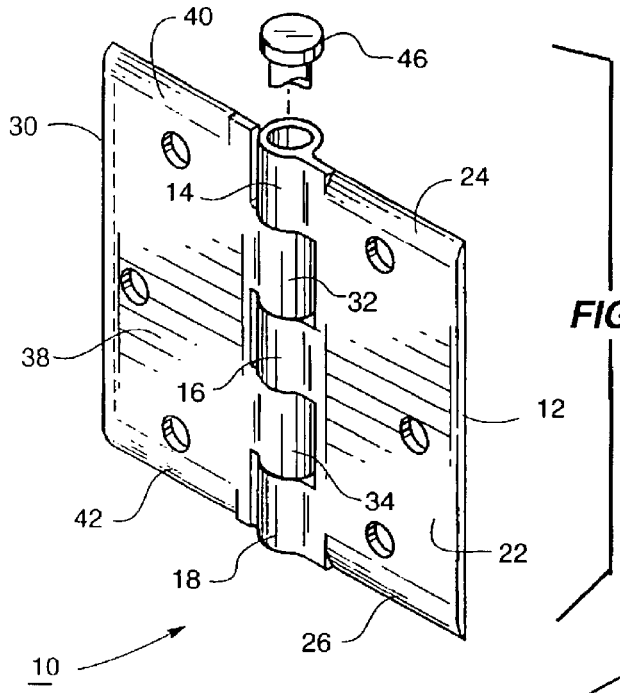
FIG. 1 is a perspective view of a hinge of the present invention.

FIG. 1 is a perspective view of a leaf hinge 10 of the present invention. The hinge 10 includes two leaves 12 and 30. The leaf 12 includes three pin cylinders 14, 16, and 18. The leaf 10 also includes a rear side 22 which has a top concavely rounded top edge 24 and a concavely rounded bottom rear edge 26. Three apertures 28 extend through the leaf 12 for receiving appropriate fastening elements, typically screws, for securing the leaf 12 in a hinge recess.

The leaf 30 includes two pin receiving cylinders 32 and 34 which are interleaved with the cylinders 14, 16, and 18 of the leaf 12 for securing the two leaves together. The leaf 30 also includes a rear or back side 38 and a top convexly rounded edge 40 and a convexly rounded bottom rear or back edge 42. Three apertures 44 extend through the leaf 30 for receiving fastening elements, such as screws, for securing the leaf in a hinge recess.

A hinge pin 46 extends through the aligned and interleaved cylinders 14, 32, 16, 34, and 18 for securing the two leaves 12 and 30 together to define the hinge 10.

Figure 2:
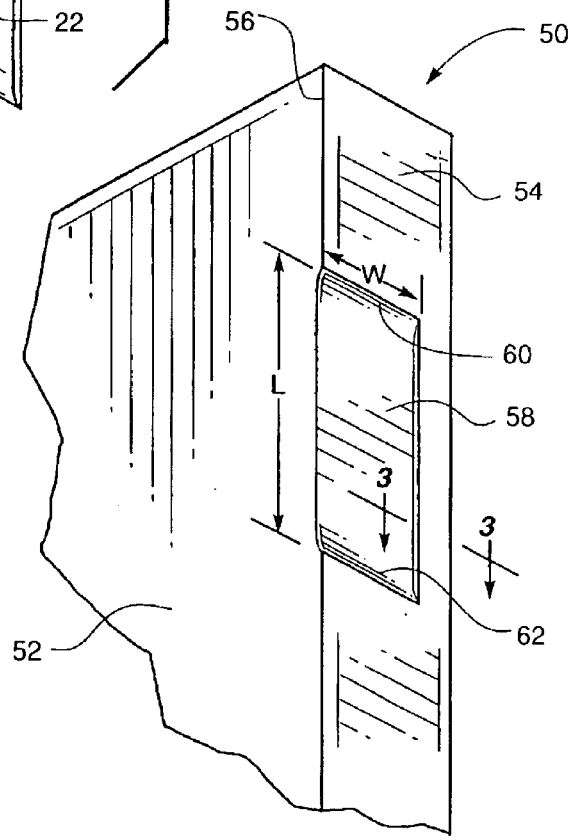
FIG. 2 is a perspective view of a portion of a door for receiving the hinge of FIG. 1.
Figure 3:
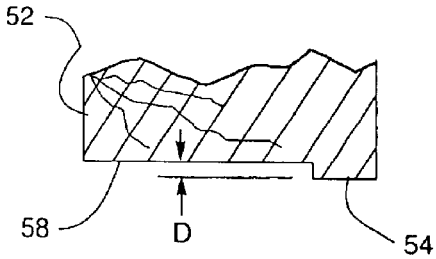
FIG. 3 is a side view in partial section taken generally along line 3—3 of FIG. 2.
Figure 4:
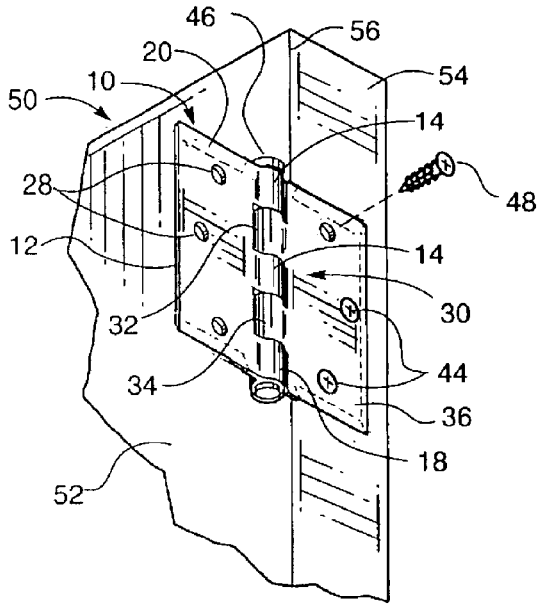
FIG. 4 is a perspective view of the hinge of FIG. 1 installed in the door of FIG. 2.

FIG. 2 is a perspective view of a portion of a door 50 showing a recess 58 for receiving a leaf of a hinge. FIG. 3 is a view in partial section taken generally along line 3—3 of FIG. 2. FIG. 4 is a perspective view of the portion of the door 50 with the leaf 30 disposed in the recess 58. For the following discussion, reference will primarily be made to FIGS. 2, 3, and 4.

The door. 50 includes a front face 52 and a hinge edge 54. The door 50 also includes a juncture 56 of the front face 52 and the edge 54. The recess 58 extends inwardly from the juncture 56 and downwardly into the edge 54 from its surface. The recess 58 includes a top concavely rounded top portion 60 and a concavely rounded bottom portion 62. The concavely rounded top and bottom portions 60 and 62 receive the convexly rounded top and bottom edges 40 and 42 of the hinge leaf 30. This is shown in FIG. 4.

With the rear or back side of the leaf 30 disposed in the recess 58, appropriate fastening elements, such screws, one of which, a screw 48, shown spaced apart from one of the apertures 44, extend through the apertures 44 to secure the leaf 30 in the recess 58 and to the door 50. The fastening elements extend through the apertures 44 from a front side 36 of the leaf 30. The leaf 12 also includes a front side 20, as shown in FIG. 4. The leaf 12 includes a plurality of apertures 28 which receive appropriate fastening elements, such as screws, to secure the leaf 12 to a door jamb and in a hinge receiving recess on a door jamb. This will be discussed in more detail in conjunction with FIG. 5, below.

The recess 58 is appropriately dimensioned for a particular hinge. The length of the recess 58 is illustrated by the letter L, and the width by the letter W in FIG. 2. The depth of the recess 58 conforms to the thickness of the hinge leaf which will be disposed in the recess so that the front face of the hinge will be even with the front face of the end 54. This is so for the hinge recesses on a door and also on a door frame, as is well known and understood. The convex and concave portions on a leaf and in a recess matingly engage each other, as may be understood from FIGS. 1 and 2.

FIG. 3 is a view in partial section taken generally along line 3—3 of FIG. 2, illustrating the depth D of the recess 58. The depth D is measured from the plane of the edge 54 to the bottom of the recess 58.

Figure 5:
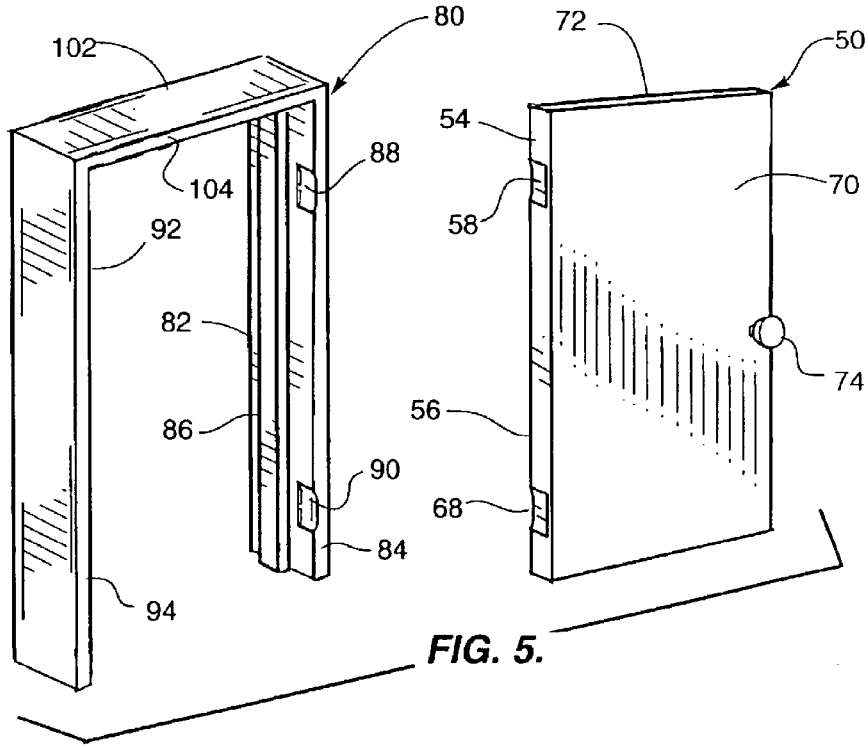
FIG. 5 is an exploded perspective view of a door spaced apart from a door frame with both elements having recesses for receiving hinges of the present invention.

FIG. 5 is an exploded perspective view of the door 50 spaced apart from a door frame 80. For the following discussion, reference will primarily be made to FIG. 5.

The door 50, as illustrated in FIG. 5, includes a back face 70 and a top 72. A door handle hole 74 is also shown extending through the door 50 for receiving a handle set. Two hinge leaf receiving recesses 58 and 68 are shown on the door end 54.

The door frame 80 includes two vertical members 82 and 92 and a top member 102. The vertical member or door jamb 82 includes a front face 84, and two hinge leaf recesses 86 and 88 extend downwardly from the surface of the inside of the member or jamb 82 and inwardly from the front face 84. The recesses 88 and 90 are appropriately aligned with the recesses 58 and 68 on the door 50.

The aligned hinge recesses 58, 68, and 88, 90 include concavely rounded top and bottom ends for receiving the convexly rounded top and bottom rear edges of hinge leaves, such as on the hinge 10 as discussed above and as illustrated in FIG. 1, and as shown assembled in FIGS. 2 and 4.

It will be noted that the leaves 12 and 30 include square corners, and that the hinge recesses in the door and door frame also include square corners. The square corners for the recesses are made by routing the recesses inwardly from the door front face generally parallel to the edge, and generally perpendicular to the door front face, as opposed to the reverse, namely perpendicular to the edge and parallel to the face, as is typically done in the prior art, and as discussed above in the Background of the Invention portion herein.

Figure 6:
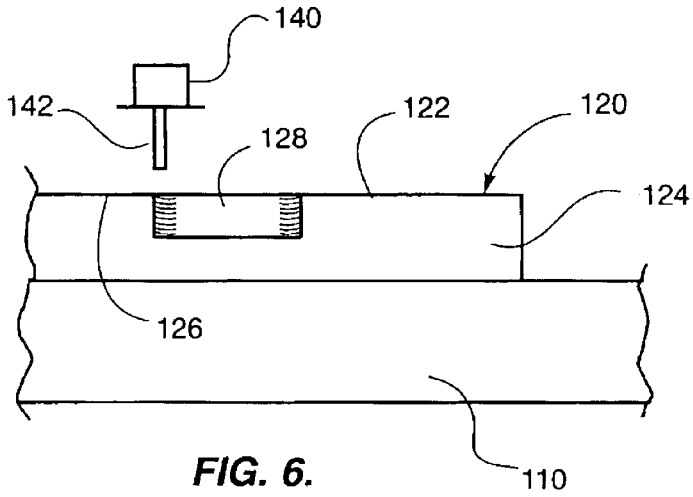
FIG. 6 is a schematic representation illustrating a method of making a recess in a door for receiving hinges of the present invention.

The routing of a hinge recess is schematically illustrated in FIG. 6. A door 120 is shown disposed horizontally on a table 110. The door 120 includes a front face 122 and an edge 124. A juncture 126 is defined at the front face 122 and the edge 124. A router 140, with an appropriate bit 142 having a predetermined length and diameter, is disposed adjacent to the front face 122 at the juncture 126. The router 140 is disposed generally parallel to the edge 124 and generally perpendicular to the face 122.

For forming or routing a hinge recess 128, the router 140 moves inwardly to the door 120 at the front face for a distance equal to the width of a hinge plate, which defines the width of the recess 128, and then moves by relative motion between the door and the router for a distance equal to the length of the hinge leaf, which defines the length of the recess. The recess 128 is thus formed. The router 140 retracts or moves outwardly from the door 120 when the desired length of the recess 128 has been routed.

For the relative motion, either the door 120 or the router 140 moves. Since the router 140 moves in and out, longitudinal movement of the door 120 may be preferable. For mass production, the door 120 may be disposed on a conveyor which indexes the door 120 as appropriate for the routing of the hinge recesses, and the door moves the predetermined distance while the router 140 is in position to make the hinge recess.

As the router 140 moves inwardly at the juncture 126, the inherent roundness of the router's bit 142 makes the concave curvature for the recess 128 at both the top and bottom portions or ends of the recess. The appropriate bit diameter is selected for the desired concavity of the ends of the recess and the desired depth of the recess. The length of the router bit is correlated with the desired width of the hinge recess to be made.

Figure 7:
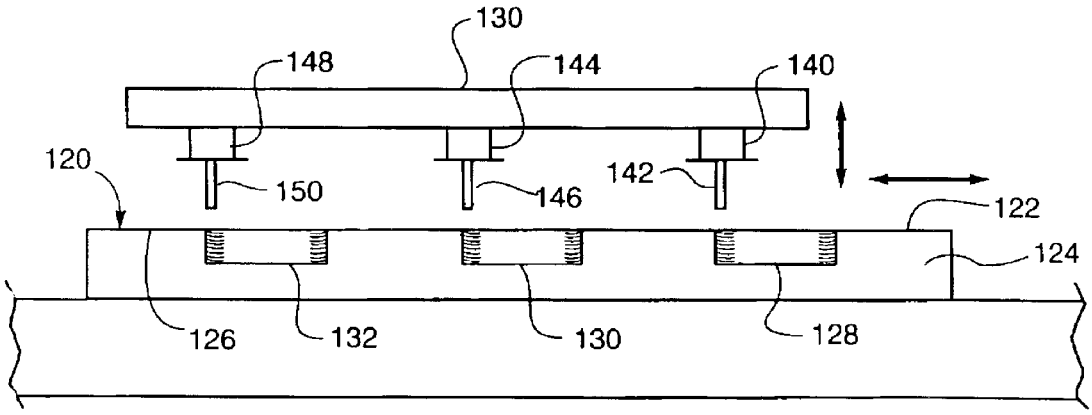
FIG. 7 is a schematic top view representation illustrating a method of making a plurality of hinge receiving recesses for hinges of the present invention in a door.

FIG. 7 is a schematic representation of a ganged router frame 130 adjacent to the door 120, illustrating a method for the generally simultaneous routing of three hinge recesses for a relatively heavy door, such as an outside door. Generally, for interior doors, only two hinges are required because the interior doors are generally lighter, hollow core doors, as opposed to generally heavier, solid core exterior doors, which usually have three hinges.

The door 120 is disposed horizontally on the table or conveyor 110, with the edge 124 extending longitudinally on the table or conveyor. The router frame 130 has three routers 140, 144, and 148 secured to it. The routers 140, 144, and 148 are spaced apart a predetermined distance according to the desired spacing of the hinge recesses for the door 120. The routers 140, 144, and 148 are ganged together in the frame 130 for substantially simultaneous movement. This allows a plurality of recesses, namely three recesses, or one recess for each router, to be made substantially simultaneously with a single pass of the routers for the desired length of the recesses to be routed. The routers 140, 144, and 148 include bits 142, 146, and 150, respectively.

The double ended arrows illustrate the relative movements required in the routing operation. Typically, the router frame 130 moves in to the door at the beginning of the routing procedure and then there is relative motion, typically by the door, for the actual routing. Then, at the end of the routing step, the router frame 130 moves outwardly, away from the door 120. The door 120 then moves along the conveyor or the table 110, and a new door is indexed for the routing of its hinge recesses.

As indicated above, the diameter of a router bit is selected in accordance with the desired radius of the concavity of the top and bottom portions of the hinge recess to be made. Moreover, the router bit is positioned relative to the plane of the surface, namely the plane of the edge 124, from which the recess will be routed to provide the desired depth of the recess. The depth of the recess, of course, is determined by the thickness of the hinge leaf for which the recess is desired.

Note that the method described herein provides inherently square corners for the hinge recesses and that only a single pass or movement of a door is required to make a hinge recess. Time and labor are thus saved by the present apparatus and method and the resulting hinge recesses provide for receiving square corner hinges. This has also been discussed above.

Furthermore, while the door 120 in FIGS. 6 and 7 is shown as horizontally disposed, with the router(s) disposed vertically, it is obvious that the door and router(s) may be oriented ninety degrees, with the door vertical and the router(s) horizontal, if desired. Contemporary technology, such as CNC machines, is quite capable of controlling the necessary sequential movements of the door and the router (s) in both orientations. Along with the plurality of recesses, pilot holes for screws to secure the hinges to both the door and the door frame may also be made for convenience in the later securing of the hinges to doors and frames. Again, CNC machines are capable of controlling such drilling with multiple drills or with single drills, if desired. The pilot hole drilling is especially advantageous when doors and frames are shipped unassembled.

Note also that the router bits are disposed at the desired location relative to the plane of the edge of a door to provide the desired depth for the recesses, and then in a single inward movement, in a single longitudinal movement, and in a single outward movement, the plurality of recesses, or three in the example, are substantially simultaneously routed or made.

Finally, it will be noted that the door 120 may also be considered as a door jamb for a door frame for routing purposes, as discussed. Referring to FIG. 5, the routing of the recesses 88 and 90 in the door frame element or jamb 82 is substantially the same as the routing of the recesses 58 and 68 in the door 50. That is, the same procedure is used for making the hinge recesses in both the door and the door jamb. And this same procedure of routing from generally parallel to an edge may also be used for making other recesses for other door hardware, such as recesses for strike elements.

While the principles of the invention have been made clear in illustrative embodiments, without departing from those principles there may occur to those skilled in the art modifications of structure, arrangement, proportions, the elements, materials, and components used in the practice of the invention, and otherwise, which are particularly adapted to specific environments and operative requirements. The appended claims are intended to cover and embrace any and all such modifications within the limits only of the true spirit and scope of the invention.

I claim:

1. Hinge apparatus comprising in combination:

a first leaf having a front surface and a back surface and top and bottom edges, and having the top and bottom edges rounded at the back surface;

a second leaf having a front surface and a back surface and top and bottom edges, and having the top and bottom edges rounded at the back surface; and means for securing the first and second leaves together.

2. The hinge apparatus of claim 1 in which the means for securing the first and second leaves together include mating cylindrical elements secured to the first and second leaves and a pin extending through the mating cylindrical elements.

3. Hinge apparatus for securing a pivoting door to a fixed door jamb comprising in combination:

a first hinge including a first leaf to be secured to the pivoting door and a second leaf to be secured to the fixed door jamb, including
- a front surface on both leaves,
- a back surface on both leaves,
- the front and back surfaces each have top and bottom edges, and
- the top and bottom edges of the back surfaces are rounded;

a first recess on the fixed door jamb for receiving the first leaf, including
- a top portion and a bottom portion,
- a rounded end at the top portion for matingly engaging the rounded back surface of the top edge of the first leaf, and
- a rounded end at the bottom portion for matingly engaging the rounded back surface of the bottom edge of the first leaf;

a first recess on the pivoting door for receiving the second leaf, including a top portion and a bottom portion,
- a rounded end at the top portion for matingly engaging the rounded back surface of the top edge of the second leaf,
- a rounded end at the bottom portion for matingly engaging the rounded back surface at the bottom edge of the second leaf;

means for securing the first and second leaves to the door and to the doorjamb; and means for securing the first and second leaves together for pivotly securing the door to the jamb.

* * * * *